US006766749B2

(12) United States Patent
Lacabanne

(10) Patent No.: US 6,766,749 B2
(45) Date of Patent: Jul. 27, 2004

(54) PREFORMED MODULES TO MANUFACTURE PALLETS AND PALLETS OBTAINED THEREFROM

(75) Inventor: Carlos Fabricio Lacabanne, Buenos Aires (AR)

(73) Assignee: Plaspalet S.A., Province of Buenos Aires (AR)

( * ) Notice: Subject to any disclaimer, the term of this patent is extended or adjusted under 35 U.S.C. 154(b) by 0 days.

(21) Appl. No.: 09/871,736

(22) Filed: Jun. 4, 2001

(65) Prior Publication Data

US 2002/0011194 A1 Jan. 31, 2002

(30) Foreign Application Priority Data

Jun. 7, 2000 (ES) ..... 200001440

(51) Int. Cl.[7] ..... B65D 19/36
(52) U.S. Cl. ..... 108/56.3; 108/57.19; 108/901
(58) Field of Search ..... 108/50.11, 901, 108/902, 57.19, 56.1, 56.3

(56) References Cited

U.S. PATENT DOCUMENTS 3,878,796 A * 4/1975 Morrison ..... 108/56.1
5,101,737 A * 4/1992 Gomez ..... 108/57.1
5,417,167 A * 5/1995 Sadr ..... 108/901
5,456,189 A * 10/1995 Belle Isle ..... 108/57.17
5,720,229 A * 2/1998 Schrage ..... 108/55.5

FOREIGN PATENT DOCUMENTS

FR 2481-675 * 11/1981 ..... 108/901

* cited by examiner

*Primary Examiner*—Lanna Mai
*Assistant Examiner*—Jerry A. Anderson
(74) *Attorney, Agent, or Firm*—Dickinson Wright PLLC

(57) ABSTRACT

Preformed modules for making pallets include basic crossbar profiles and additional long and short crossbar profiles, basic and additional board profiles, and connection fittings. Each crossbar profile includes a preformed body having a cross section with a framework of laminar baffles, which define a plurality of cells, a perimetric covering, and longitudinally extending engagement elements. Each of the basic and additional board profiles is laminated and includes a plurality of cells, a perimetric covering, and at least one longitudinal engagement element on the perimetric cover. The crossbar profiles support the board profiles by means of the connection fittings. A pallet includes some or all of the modules described above.

19 Claims, 12 Drawing Sheets

1
2
3
4
5
6
7
30
32
34
36
38

9
12
10
11
40
44
42
30
2a
31

PREFORMED MODULES TO MANUFACTURE PALLETS AND PALLETS OBTAINED THEREFROM

FIELD OF THE INVENTION

The present invention relates to elements to move and manipulate cargoes in general, more particularly it refers to a frame known as pallet, to support packages so that the same can be easily moved by lifting machines, being their essential characteristic that they are obtained from preformed modular elements.

BACKGROUND OF THE INVENTION

Several embodiments of these platforms so popular are taught by the previous art. The traditional platforms are made by means of stringers of hard or mechanically resistant woods, fixed to each other by two layers of wood boards. To make each platform, iron brackets and angles are used to keep the junctions engaged to each other. It is well-known the considerable expense on wood such as quebracho, saligna, eucalyptus, pine, etc. and labor to make these pallets. To minimize the effects of these high costs, used pallets are sometimes reprocessed, replacing the damaged elements, fixing them again in position, which generally is disjointed due to the tough treatment they undergo during operation and transportation to get them out from the field.

Alternatives with the use of plastic materials have been considered but so far their cost is still high and they were not able to solve all the problems of movement of materials by pallets, because their application is limited to move relatively reduced cargoes.

SUMMARY OF THE INVENTION

It is a main object of the invention to provide a new type of element, highly simple and economic, that may be used as a support base of cases and shipping containers of different goods, fruit and vegetables cases, etc., so that they can be manipulated by fork lifting machines, to transport them from one place to another, lift them, perform loading and unloading operations, from plantations, transient storage warehouses, refrigerating chambers, or also from and to trucks, ships, warehouses, etc., that is to say all the operations these devices were designed to. It has the outstanding benefit that every module that comprise the invention, can be obtained from preformed elements, made of any of the appropriate materials.

It is an important object of the invention that the modular arrangement to be described, with its own and known function, is materialized through components manufactured from profiles made of laminar baffle frameworks that besides they made the parts thus obtained lighter, they increase the specific strength required by each component.

A further object of the invention is that due to the simplicity of the interconnection of the modular elements assembled in accordance with the principles of the invention, the construction of each unit can be performed in a very short time, also the nature of each module allows various construction alternatives according to the application or use of the new supporting frame of the "pallet" type obtained through the special modules of the invention.

There are other benefits of the invention, such as to obtain a new constructive arrangement highly simple and economic, that allows to manufacture several different pallets with features to load units out of service or applicable to different characteristics of the massive movement of cases, packaging, boxes, containers of good, construction materials and similar elements, wherein the platforms known as pallets are essential to allow the use of fork lifting machines and handle the cargoes rapidly and easily.

Double inlet pallets can also be assembled.

To solve the problems associated with conventional platforms, with said evident benefits as regards quick assembly of the units and variety of pallets that can be obtained with the modular elements that comprise the invention, the applicant has designed a structural configuration of each module extremely simple, easy to implement that is complemented with simple means of interconnection, with a cost much lower than the pallets used at present, which use as usual, crossbars that support a platform comprised by a plurality of boards mounted on the same.

The term "profile" as used in the description of the modules has its usual technical meaning, to refer to the components as units integrally formed with a given cross section.

In accordance with one aspect of the invention, preformed modules for making pallets include basic crossbar profiles and additional long and short crossbar profiles, basic and additional board profiles, and connection fittings. Each crossbar profile includes a preformed body having a cross section with a framework of laminar baffles, which define a plurality of cells, a perimetric covering, and longitudinally extending engagement elements. Each of the basic and additional board profiles is laminated and includes a plurality of cells, a perimetric covering, and at least one longitudinal engagement element on the perimetric cover. The crossbar profiles support the board profiles by means of the connection fittings.

In accordance with another aspect of the invention, a pallet includes at least three basic crossbar profile modules, cover fittings, a plurality of board profile modules, and connection fittings. Each crossbar profile module includes a preformed body having first and second ends, first and second opposing surfaces, and a cross section, wherein the cross section has a framework of laminar baffles that define a plurality of cells, a perimetric covering and longitudinally extending engagement elements for engaging the connection fittings. Each end of the cross profile modules is connected to one of the cover fittings. The board profile modules each have ribbed surface and resilient inserts, and each board profile module is laminated and including a plurality of cells, a perimetric covering, and at least one longitudinal engagement element on the perimetric covering.

In accordance with a further aspect of the invention, a pallet includes additional short crossbar profile modules, three additional board modules, and a plurality of basic board modules. Each additional short crossbar profile module has upper and lower surfaces, a pair of male engagement elements on its upper surface and a female engagement element on its lower surface. Each additional short crossbar profile module further includes a preformed body having first and second ends, and a cross section. The cross section has a framework of laminar baffles that define a plurality of cells and a perimetric covering. The three additional board modules are engaged with the upper surfaces the additional short crossbar profile modules. Some of basic board modules are supported by the three additional board modules by means of connection fittings, and the other basic board modules are connected to the lower surfaces of the additional short crossbar profile modules and define two inlets for insertion by the fork of a lifting machine. Each of the basic and additional board profile modules is laminated and includes a plurality of cells and a perimetric covering.

In order to provide a better understanding of the present invention, so that the same can be easily embodied, the following paragraphs will provide a detailed description of a preferred form of the invention, referring to the attached illustrative drawings, to exemplify but not to limit the invention, which components can be selected among several equivalents without departing from the principles of the invention established in these presents.

BRIEF DESCRIPTION OF THE DRAWINGS

In the preceding figures, the same references denote identical or corresponding parts.

DETAILED DESCRIPTION OF EMBODIMENTS OF THE INVENTION

Figures 1, 2, 3:
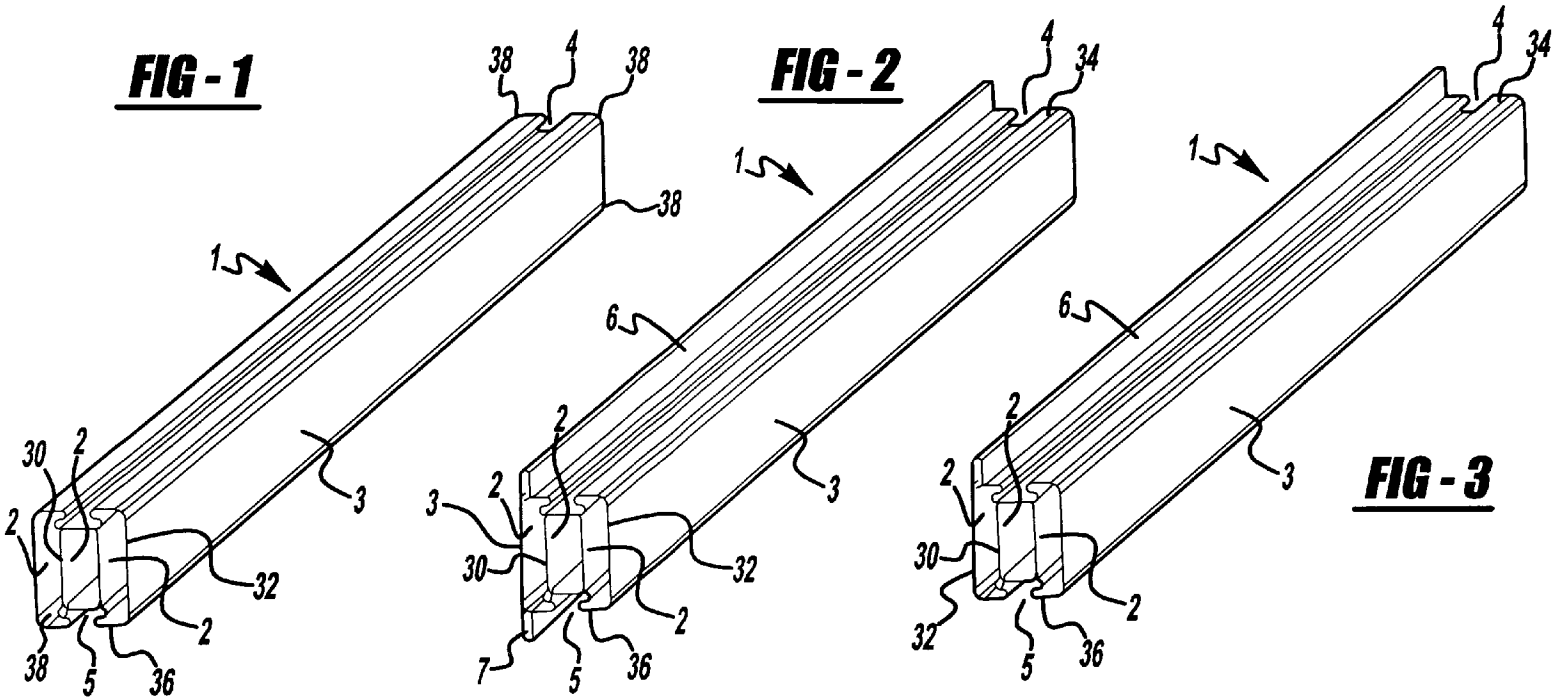
FIG. 1 is a perspective view of a crossbar profile that comprises one of the basic modules of the invention.
FIG. 2 shows the crossbar profile with the incorporation of an extension of one its lateral flat faces whereby a pair of longitudinal cover wings are determined.
FIG. 3 shows the crossbar profile with only one longitudinal cover wing.

FIGS. 1–16 show components of the invention that may be assembled in a variety of pallet embodiments, four representative embodiments being illustrated in FIGS. 17–18, 19–20, 21–22, and 23–24, respectively. In accordance with FIGS. 1, 2 and 3, the basic components of the pallet embodiments include a crossbar profile 1 having integral frameworks of laminar partitions 30 that define adjacent cells 2, a perimetric covering 32 with lateral flat faces 3, and a female longitudinal engagement means 4 and 5 on the upper and lower faces 34 and 36 respectively. The crossbar profile 1 of FIG. 1, has four rounded longitudinal corners 38 while the crossbar profile 1 of FIG. 2 has upper and lower longitudinal wings 6 and 7 extending from one of its two lateral flat faces 3, and the crossbar profile 1 of FIG. 3 has only one longitudinal extension that defines an upper wing 6.

Figures 4, 5, 6, 7A, 7B:
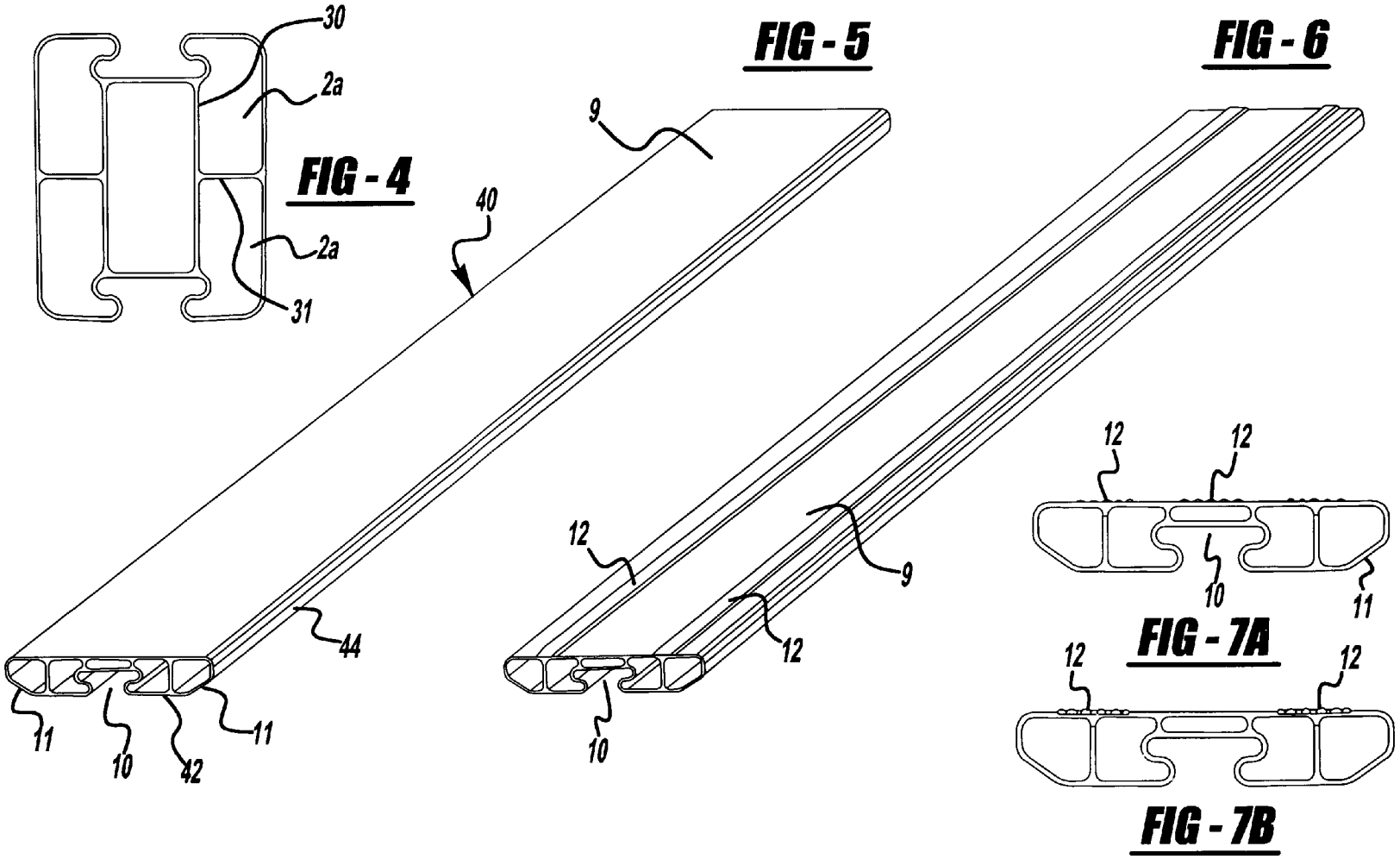
FIG. 4 is a view of the cross section of the crossbar profile according to an alternative of construction of its internal framework.
FIG. 5 is a perspective view of the module that comprises the board profile that forms the platform.
FIG. 6 is a perspective view of another embodiment of the cover board profile longitudinally ribbed.
FIG. 7*a*) is a cross-sectional view of a board profile with the slotted surface, while FIG. 7*b*) is the same cross-section wherein inserts made of a resilient material are included.

In FIG. 4, the cells 2 of the crossbar profile 1 shown in FIGS. 1–3 split by respective cross partitions 31 into cells 2*a,* to increase the mechanical strength of the crossbar.

FIG. 5 shows the cover boar profile 40 forming a platform surface of the pallet. The cover board profile structure is also cellular and includes a generally flat upper plane 9, a lower narrower face 42, lateral edges 44, and sloped planes 11. A female longitudinal socket 10 extends from the lower narrower face 42. In FIGS. 6 and 7*a*) and *b*) the upper plane 9 of the profile includes, ribbed or slotted strips 12 which may be made of the same material as the cover board (FIGS. 6 and 7*a* or formed by inserts of elastomeric material as depicted by inserts 12*a* in FIG. 7*b*). In both instances, the ribs or slotted strips are preferably distributed in two or three longitudinal strips to inhibit, displacement of cargo transported on the pallet.

Figures 8, 9A, 9B, 9C, 16:
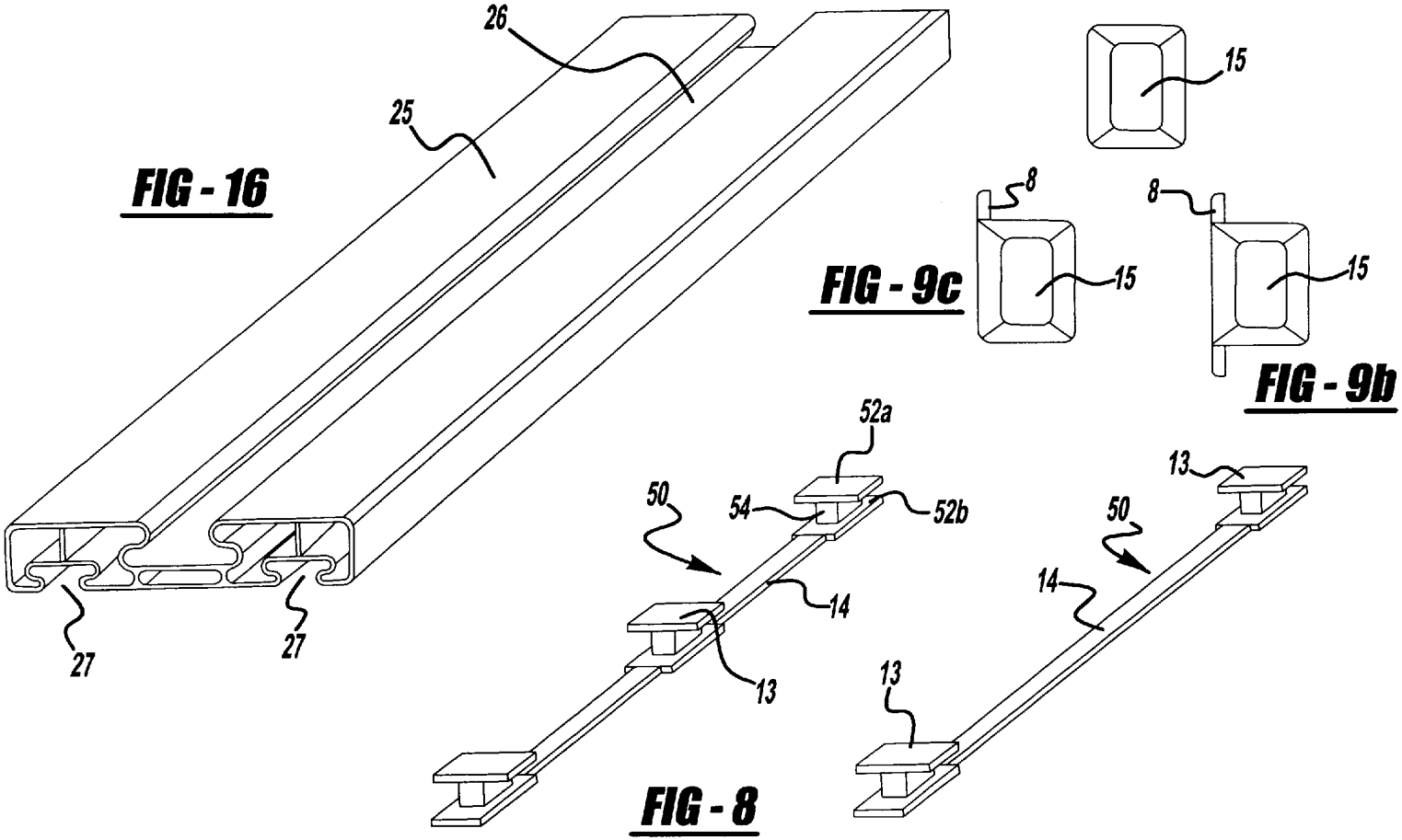
FIG. 8 is a perspective view of the connection fittings in two possible positions. They are used to assemble the structure.
FIGS. 9*a*, 9*b*, and 9*c* show front views of respective end covers for the three embodiments of the crossbar profiles.
FIG. 16 is a perspective view of a board profile module that will be used with the modules of FIGS. 10 to 15.

Connection fittings 50 are detailed, and shown in FIG. 8 to include crosses 13 formed by a pair of laminar plates 52*a* and 52*b* connected to each other by a core 54. The thickness of the core and the dimensions of the plates, take into consideration the corresponding dimensions of the said engagement means (e.g., engagements means 4 and 5 on the crossbar profiles and female longitudinal socket 10 in the board profiles), which operatively house the plates to effect interconnection. The plates 52*b* are slidably mounted on strips 14 to form the connection fittings.

FIGS. 9*a*, 9*b*, and 9*c* illustrate the three embodiments of the covers 15 applicable, according to each case, to the crossbar profiles shown in FIGS. 1, 2 and 3, respectively. The respective covers have wings 8 located in one or two of the corners of the same side, symmetrically replicated, with fixing elements to attach to the ends of the crossbar modules either to the left or right position as appropriate.

Figure 10:
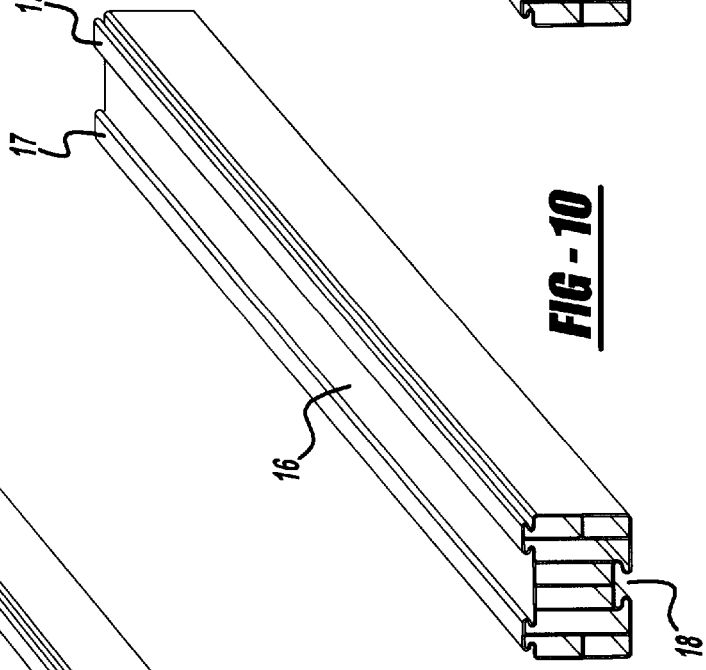
FIG. 10 is a perspective view of the module consisting of the additional crossbar profile to make rackeable type pallets, that is to say stackable.
Figure 11:
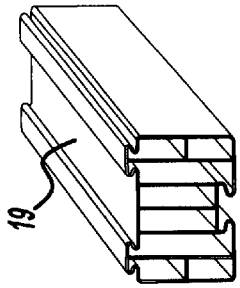
FIGS. 11 and 12 show alternatives to the front module in embodiments of intermediate and short length.
Figure 12:
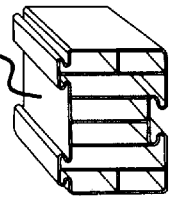
Figure 23:
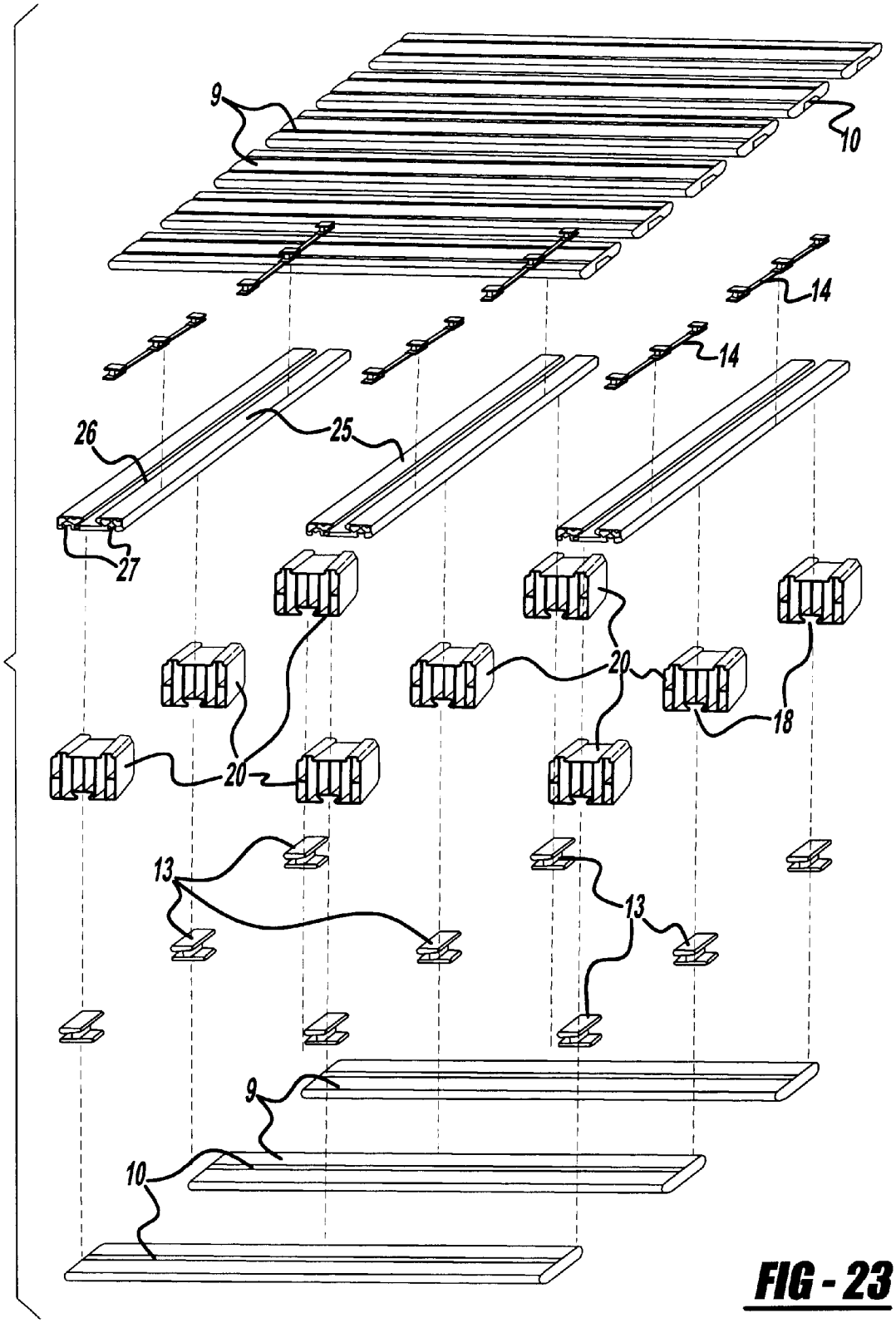
FIG. 23 corresponds to the assemble scheme of the stackable (rackeable) pallet
Figure 24:
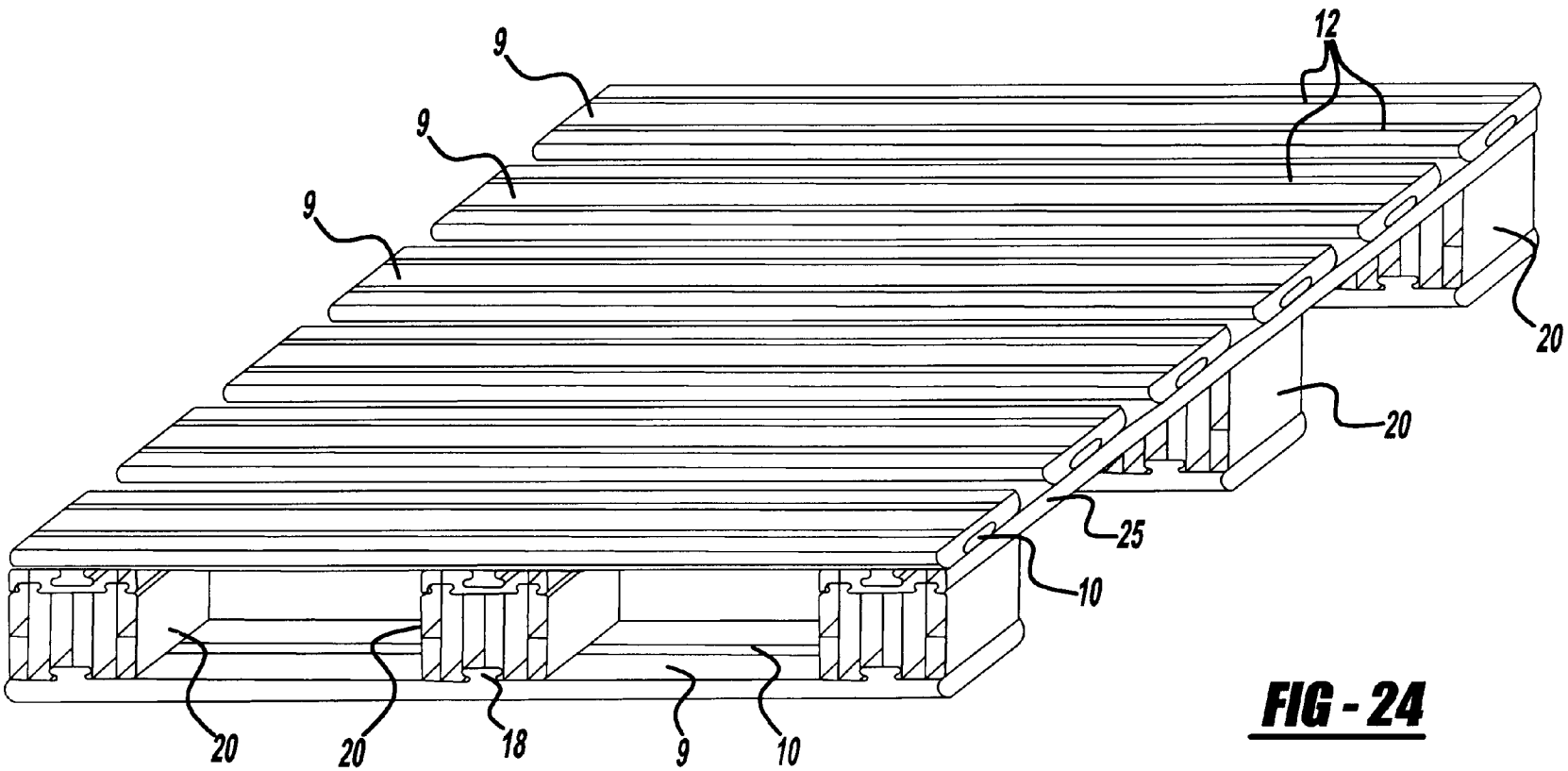
FIG. 24 shows the finished pallet according to the scheme of the previous Figure.

FIG. 10 shows a module element named additional crossbar profile 16 that has a pair of male longitudinal sockets 17 on its upper face, close to the edges of the profiles and female socket 18 on its lower face. This characteristic makes them wider than the basic crossbar profiles shown in FIGS. 1–3 and therefore their internal cells are multiplied to keep the mechanical conditions at an optimal level. FIGS. 11 and 12 show this additional crossbar profile with different lengths, one intermediate 19 and the other shorter 20. Fragmentation of the crossbar into several sections permits assembly of the modular components to obtain pallets of the double inlet type and ease the construction of stackable or "rackeable" pallets as shown in FIGS. 23 and 24.

Figure 15:
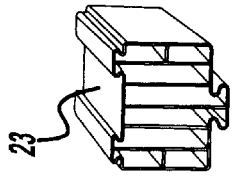
FIGS. 13, 14 and 15 are perspective views of the additional crossbar profile, in its three typical dimensions, applied to construct non-rackeable pallets, that is to say non-stackable.
Figure 14:
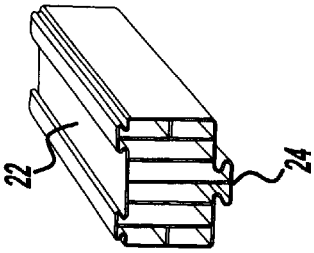
Figure 13:
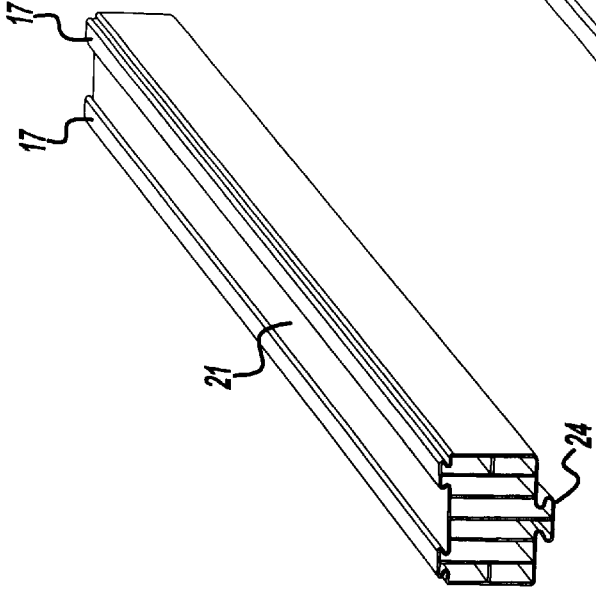
Figure 21:
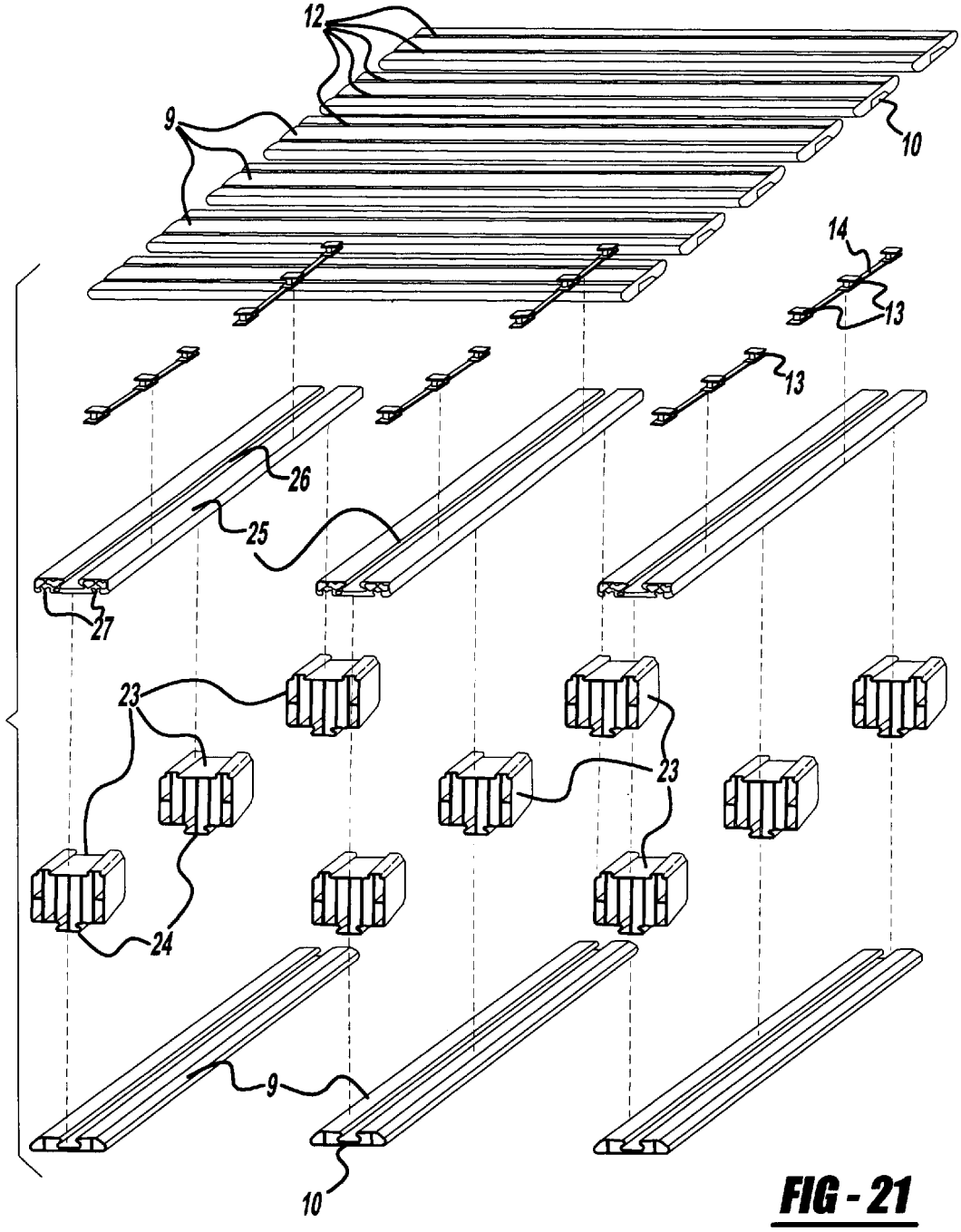
FIG. 21 is an exploded perspective view of the modules of FIGS. 10, 11 and 12 and their connection means disposed to make a double inlet non-stackable (non-rackeable) pallet.
Figure 22:
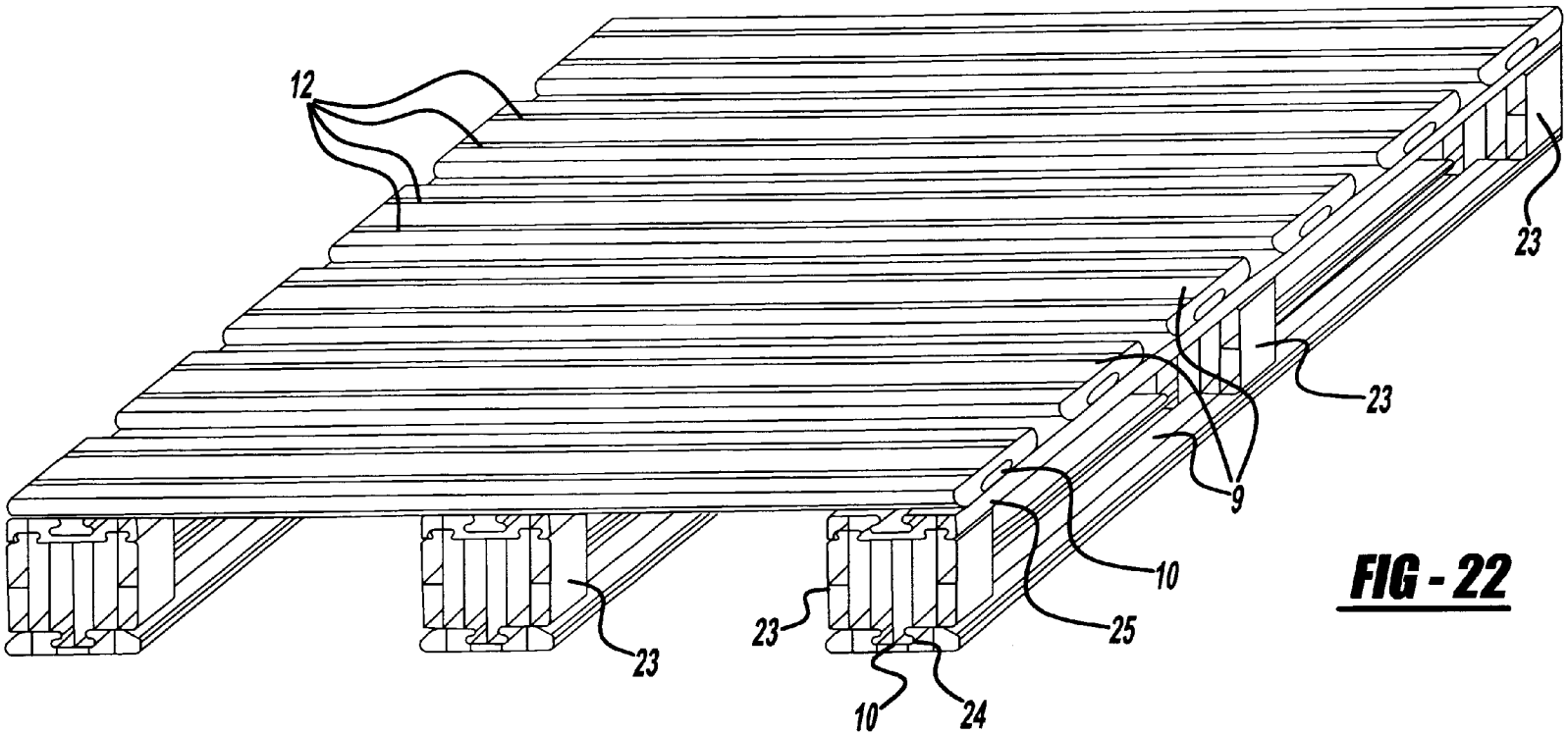
FIG. 22 shows the pallet mounted as a result of the combination and arrangement of the modules of the preceding Figure.

FIGS. 13, 14 and 15 show yet another additional crossbar profile of varying lengths including: the complete length module 21, the intermediate 22 and the short module 23. These crossbars facilitate assembly of the pallet components in a non-stackable (non-rackeable) pallet configuration as shown in FIGS. 21 and 22. The crossbar modules 21, 22, and 23 only differ from the above described correspondingly sized modules 16, 19 and 20 in that the engagement element on the lower surface is male 24.

In FIG. 16 shows an additional board profile module 25 to be used on double inlet pallets, stackable, "rackeable" and non-stackable or non-rackeable, shown in FIGS. 21–24. The modules 25 differ from the basic board profile module 9 shown in FIG. 5 in that its upper face has a longitudinal female socket 26, while t o identical female sockets are disposed on its flat lower face, 27, close to its sides.

Once stated the different components of the embodiment of the invention, described to explain the nature thereof, the description will be now complemented with the functional and operative relationship of its parts and the result they attain.

Figure 17:
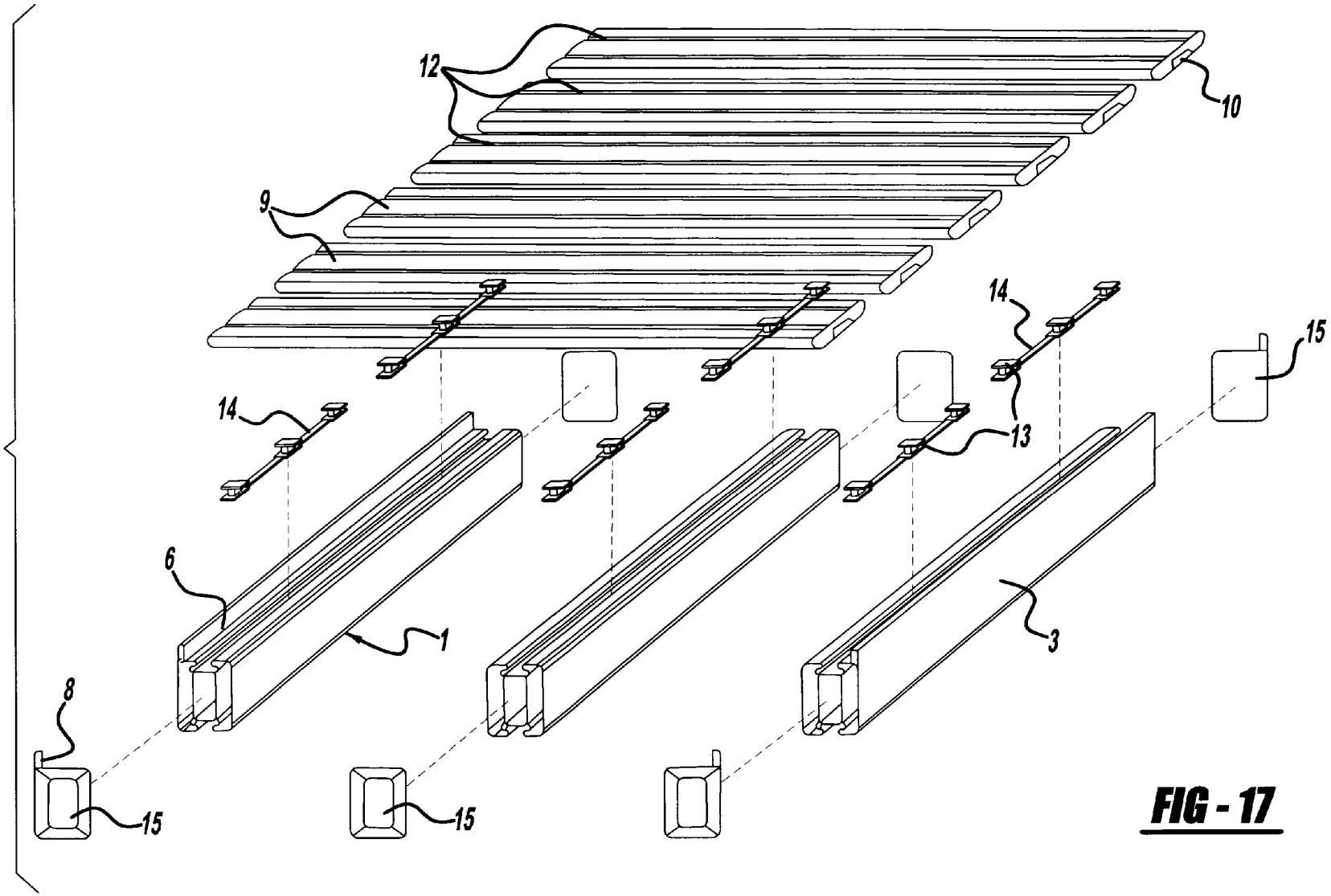
FIG. 17 represents an exploded view of the modular component elements of the invention, conveniently separated, to show the relationship existing among them in the assembly scheme of a pallet using the basic modules.
Figure 18:
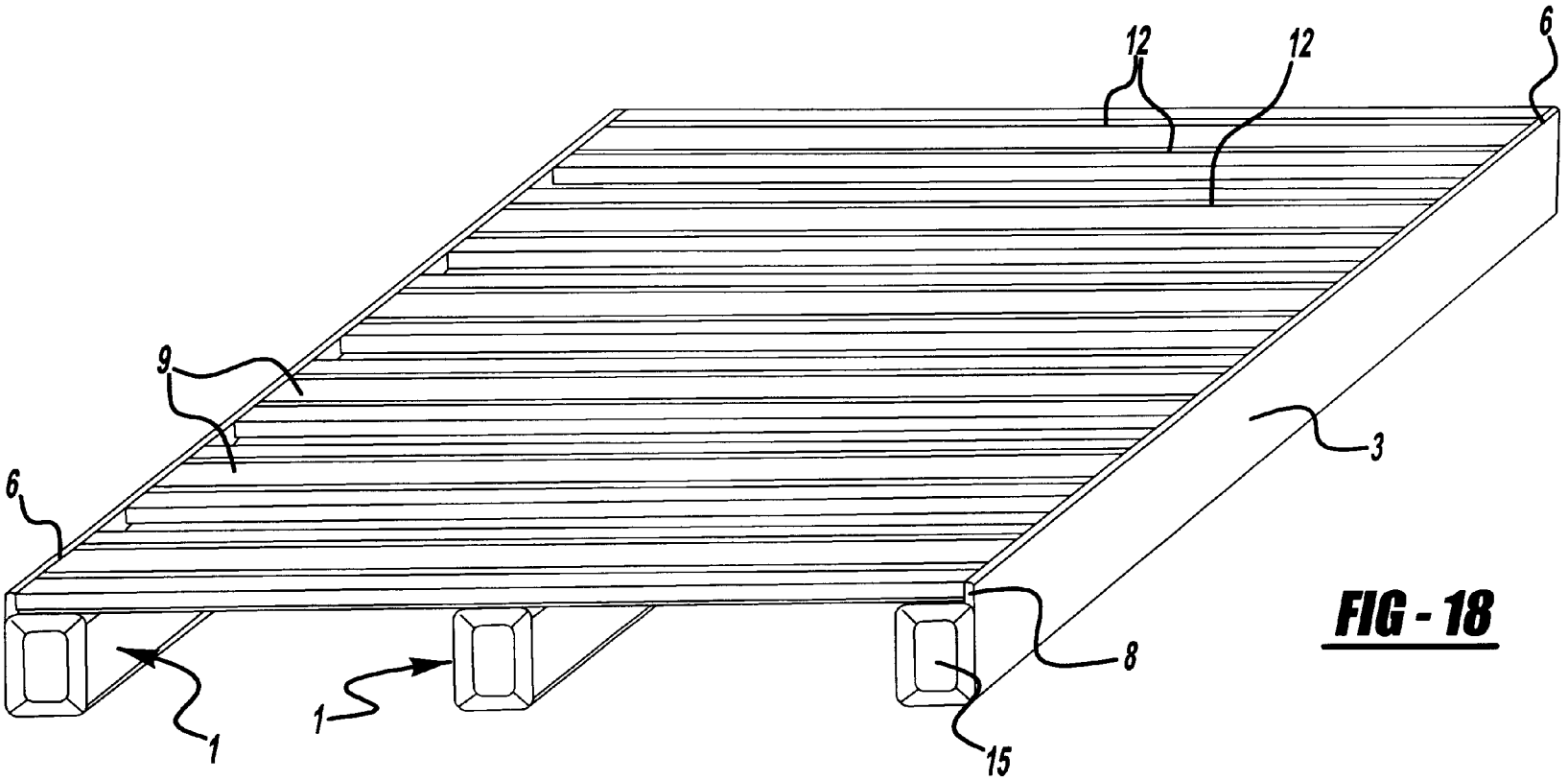
FIG. 18 is a perspective view of the finished pallet with the configuration of the previous Figure.
Figure 19:
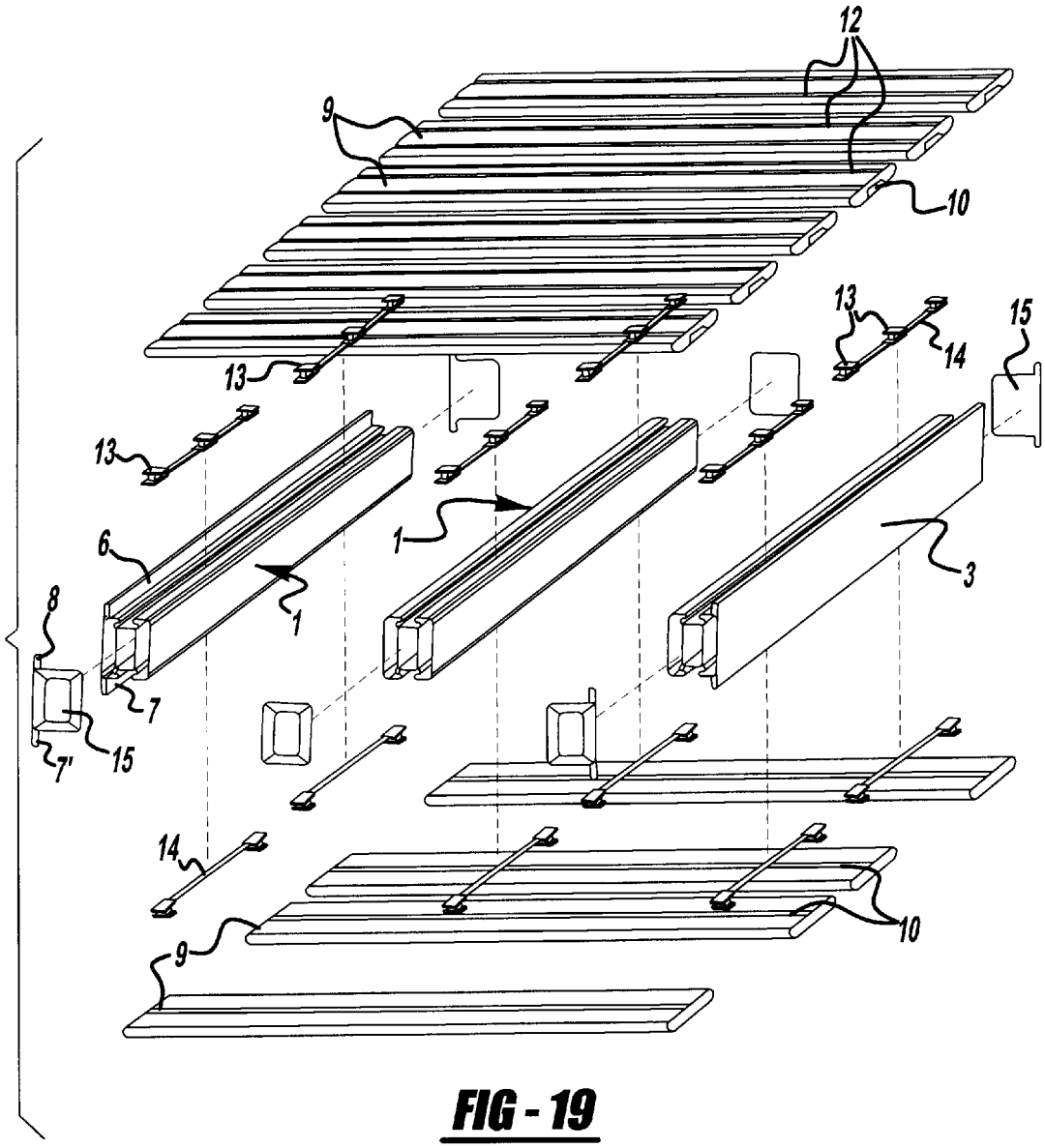
FIG. 19 is an exploded view of another way to assemble the pallet using basic modules.
Figure 20:
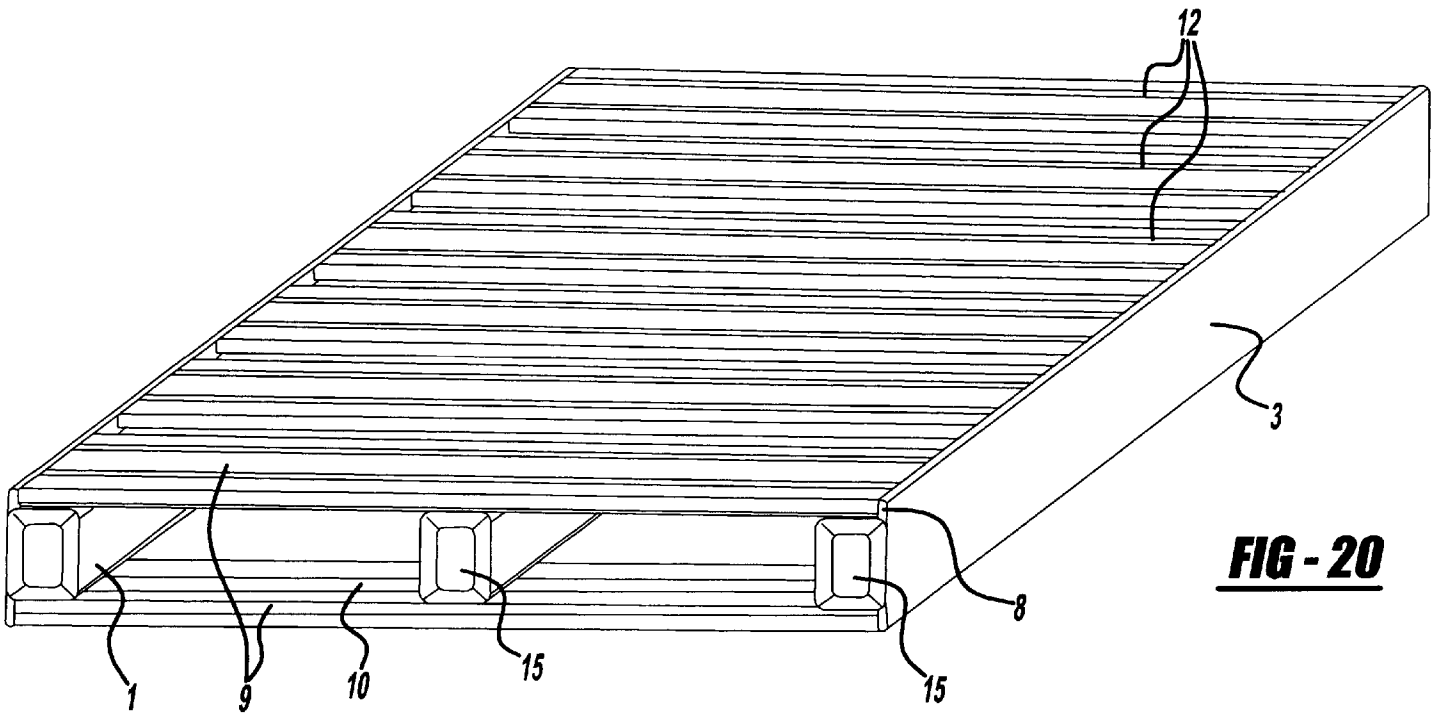
FIG. 20 is a perspective view of the finished pallet, with the configuration of the previous Figure.

Thus for conventional pallets, the basic profile modules, the crossbar profile modules shown in FIGS. 1, 2 and 3 located according to its characteristics, generally three of them, and the board profile 5–6 modules shown in FIGS. 5 and 6 to define the platform, are used, which are selected to obtain a flat or ribbed surface, and connected by using the connection fittings 50 and/or crosses 13 (FIG. 8) and covers (FIG. 9) on the front and distal ends of the corresponding crossbars, as shown in FIGS. 17 and 19, sufficiently illustrative by themselves, and by their interconnection the pallets shown in FIGS. 18 and 20 are obtained. It is to be understood that in the stackable pallet of FIGS. 22 and 4 the additional crossbar profiles 20 or 23 are connected to each other and reinforced by the board profiles.

Thus one of the possible embodiments of the invention has been described, and the way the same comprising also its specific applicability as the conventional pallets in use. This document is contemplated with the abstract of the invention and in the accompanying claims.

What is claimed is:

1. Preformed modules for making a pallet having support crossbars and a platform including a plurality of boards mounted on the crossbars, the crossbars being spaced apart to allow the introduction of the fork of a lifting machine, the preformed modules comprising:

crossbar profiles, each including a preformed hollow body having a cross section with a framework of laminar partitions that define a plurality of cells, a perimetric covering and at least one longitudinally extending engagement socket;

board profiles, each being a preformed hollow body and including a plurality of cells, a perimetric covering and at least one longitudinally extending engagement socket; and connection fittings slidably disposable in the engagement socket of the crossbar and board profiles when said engagement sockets of said crossbar and board profiles arc vertically aligned to intercouple the crossbar and board profiles such that the crossbar profiles support the board profiles by means of the fittings.

2. The preformed modules of claim 1 wherein each connection fitting includes a strip and a plurality of crosses, said strip being slidably disposable in the engagement socket of one of said crossbar or board profiles and each of said plurality of crosses being slidably disposable in the engagement sockets of the other of said crossbar or board profiles.

3. The preformed modules of claim 2 wherein said crosses are slidably attached to said strip.

4. The preformed modules of claim 2 wherein said crosses include an upper plate and a lower plate, each of said upper plates being slidably disposable in the engagement socket of one of said crossbar or board profiles and each of paid lower plates being slidably disposable in the engagement sockets of the other of said crossbar or board profiles.

5. The preformed modules of claim 4 wherein said upper plate is quadrangular.

6. The preformed modules of claim 2 wherein said crosses include an upper plate and a core, said upper plate being coupled to an end of said core spaced from said strip.

7. The preformed module of claim 6 wherein said upper and lower plates are connected by said core.

8. The preformed modules of claim 1 wherein said engagements sockets of each of said crossbars and boards extend between longitudinal ends of said crossbars and boards.

9. Preformed modules for making a pallet, including support crossbars and a platform including a plurality of boards mounted on the crossbars, the crossbars being spaced apart to allow the introduction of a fork of a lifting machine, the preformed modules comprising:

crossbar profiles, each including a preformed hollow body having a cross section with a framework of laminar partitions that define a plurality of cells, a perimetric covering and at least one longitudinally extending engagement element;

board profiles, each being a preformed hollow body and including a plurality of cells, a perimetric covering and at least one longitudinally extending engagement element; and connection fittings, each including a plurality of quadrangular plates slidably connected to a core, the plates slidably engaging the engagement elements in the crossbar profiles and board profiles.

10. The preformed modules according to claim 9, wherein each crossbar profile continuously extends a length of the pallet and two end crossbar profiles have at least one longitudinal flange coplanar with a side face, the flange and the side face forming a side cover of the pallet, a height of the flange being at least equal to a thickness of the board profiles.

11. The preformed modules according to claim 10, wherein the two end crossbar profiles have two opposite flanges coplanar with a side face, a height of each flange being equal to a thickness of the board profiles.

12. The preformed modules according to claim 9, wherein the longitudinally extending element in each crossbar profile has a T-shape or similar central groove.

13. The preformed modules according to claim 12, wherein each crossbar profile has a longitudinal central groove in opposite faces.

14. The preformed modules according to claim 9, wherein a bottom board profile has upper and lower surfaces, the lower surface having sloped planes at respective lateral sides and a longitudinal engagement groove positioned between the sloped planes, while the upper surface is plain or has longitudinal ribs.

15. The preformed modules according to claim 9, wherein the connection fittings on the covering of each module are functionally related.

16. A pallet comprising:

at least three crossbar profile modules, each crossbar profile module including a preformed hollow body having first and second ends, first and second opposing surfaces, and a cross section, the cross section having a framework of laminar partitions that define a plurality of cells, a perimetric covering and at least one longitudinally extending engagement element;

a plurality of board profile modules having smooth or ribbed surfaces, each board profile being laminated and including a plurality of cells, a perimetric covering and at least one longitudinal engagement element on the perimetric covering; and connection fittings including a plurality of quadrangular plates slidably connected to a core, the plates slidably engaging the engagement elements in the crossbar profile modules and board profile modules.

17. A pallet according to claim 16, wherein the crossbar profile modules have longitudinal engagement elements on opposite faces.

18. A pallet according to claim 17, wherein the board profile modules are mounted on the opposite faces of the cross profile modules by means of the connection fittings.

19. A pallet according to claim 16, wherein the board profile modules are mounted on a surface of the crossbar profile modules by means on the connection fittings.

* * * * *